US005727732A

United States Patent [19]

Stein

[11] Patent Number: 5,727,732

[45] Date of Patent: Mar. 17, 1998

[54] FLEXIBLE AEROSOL DELIVERY WAND WITH TIP MIXING CHAMBER

[76] Inventor: Myron Stein, 1776 Peachtree St., N.W., Suite 350-B, Atlanta, Ga. 30309

[21] Appl. No.: 677,740

[22] Filed: Jul. 10, 1996

[51] Int. Cl.[6] ..... B05B 7/04

[52] U.S. Cl. ..... 239/1; 239/433; 239/DIG. 13; 134/168 R; 134/182.2

[58] Field of Search ..... 239/433, 434.5, 239/532, 318, DIG. 13, 1; 134/168, 102.1, 102.2

[56] References Cited

U.S. PATENT DOCUMENTS

| | | | |
|---|---|---|---|
| 1,124,579 | 1/1915 | Ambursen | 239/434.5 X |
| 4,274,812 | 6/1981 | Elvidge et al. | 239/433 X |

FOREIGN PATENT DOCUMENTS

| | | | |
|---|---|---|---|
| 549873 | 12/1959 | Belgium | 239/433 |
| 76996 | 1/1954 | Denmark | 239/433 |

*Primary Examiner*—Lesley D. Morris
*Attorney, Agent, or Firm*—Isaf, Vaughan & Kerr

[57] ABSTRACT

An aerosol delivery wand has an elongated hollow tube with proximal and distal ends. A compressed air valve is provided for selectively delivering a stream of compressed air from a compressed air source to the proximal end of the tube. A tubular injector extends through the wall of the hollow tube and into the interior thereof adjacent the distal end of the hollow tube. The interior portion of the injector has sides that are contoured in the shape of an airfoil to define spaced air passageways with the interior walls of the hollow tube. The end of the injector within the hollow tube is cut to be substantially parallel to and spaced from the distal end of the hollow tube so as to define a mixing chamber between the end of the injector and the distal end of the hollow tube. Compressed air flowing through said hollow tube causes liquid to be drawn through the injector and into the mixing chamber where it is entrained in the air flow and projected from the wand as an uniformly distributed aerosol.

24 Claims, 3 Drawing Sheets

FLEXIBLE AEROSOL DELIVERY WAND WITH TIP MIXING CHAMBER

TECHNICAL FIELD

This invention relates generally to the delivery of liquids in the form of an aerosol and more specifically to elongated flexible aerosol delivery wands for delivering an aerosol to inaccessible remote locations.

BACKGROUND OF THE INVENTION

The delivery of liquids in the form of an aerosol spray has long been an efficient and effective way of coating surfaces with a thin layer of liquid for various purposes. This is particularly true in the application of fungicides, sporocides, and anti-bacterial treatments, where surfaces must be covered completely and uniformly in order to arrest the growth and spread of the offending biocontaminates. Some of the most common bacterial and fungal growths, such as Cladosporium, Acrimonium, and Aspergillus can also be the most resistant. Thus, complete and even coverage of an affected surface is even more important in eradicating these types of growths. To complicate matters, such common growths can thrive on a wide variety of surfaces, including metal or painted HVAC vents, painted wall surfaces, HVAC duct insulation, air conditioning heat exchangers, and the interior surfaces of HVAC duct work.

When treating exposed, easily accessible surfaces with fungicides or anti-bacterial formulations, common aerosol sprayers can be used. However, in many instances, offending colonies establish themselves on surfaces that are not easily accessible using common sprayers. In fact, the generally inaccessible interior elements and surfaces of air conditioning duct work, particularly in and around air conditioning heat exchangers, are unusually susceptible to fungal and bacterial proliferation. This is because these locations are usually dark and because more than ample moisture is provided by the condensation that occurs on the heat exchanger during operation of the air conditioning system. The problem is exacerbated greatly in the case of automobile air conditioning systems, wherein the duct work is small, convolutely shaped, and extremely difficult to access without substantial disassembly of surrounding structures. Unfortunately, automotive air conditioning systems are some of the most susceptible locations for colonization and thus most in need of complete and thorough biocide treatment.

In the past, the interior components and surfaces of automotive air conditioning systems have been treated with anti-fungal and antibacterial formulations by a variety of methods. One such method has been simply to disassemble the air conditioning system to expose its interior components, treat the exposed interior components with a common applicator, and reassembly the system. Clearly, this method, while effective, is extremely labor intensive and generally requires not only that the air conditioning system be disassembled but that many of the surrounding structures of the vehicle be removed as well.

In other instances, long extensions have been fitted to common aerosol sprayers and inserted through the vents or through small openings in the duct work to the interior of the system. While this technique avoids disassembly, it nevertheless has its own inherent shortcomings. For example, as the fine aerosol from the sprayer enters and traverses the length of the extension tube, it tends to agglomerate into much larger droplets and to adhere to the interior surface of the tube. This is particularly true where the tube has been bent and snaked through convolutely shaped duct work. By the time the flow exits the tube, it is no longer a fine aerosol mist but rather tends to spit and sputter from the tube in the form of large drops and blobs. The result is an incomplete and inadequate coverage of the surfaces being treated and consequent failure to arrest the offending colonies. Further, since these surfaces generally are hidden from visual inspection., it is virtually impossible to determine the extent of coverage. Accordingly, such aerosol extension tube techniques are generally ineffective.

Thus, there exists a continuing need for an improved device for delivering fungicides, sporocides, and anti-bacterial treatments to inaccessible or remotely located surfaces in the form of an evenly distributed, widely disbursed aerosol spray so that such surfaces are covered completely and evenly with the treatment. Such a device should be shapable so that it can be snaked through convolutely shaped duct work such as that found in automotive air conditioning systems, but yet should deliver the same highly dispersed aerosol regardless of its shape. The device should be simple to use, reliable, resistant to clogging, and re-shapable for use in a wide variety of applications. It is to the provision of such a device that the present invention is primarily directed.

SUMMARY OF THE INVENTION

The present invention, in a preferred embodiment thereof, comprises an elongated aerosol delivery wand for delivering a fine aerosol spray to a remote location. The wand includes a manually operable hand held compressed air valve from which an elongated hollow tube extends to a distal end. Preferably, the hollow tube is formed of a flexible, bendable material such as copper so that it can easily be bent to a desired convolute shape. A tubular injector extends at a predetermined angle into the hollow tube adjacent its distal end. The injector has an external portion extending away from the hollow tube for coupling to a source of liquid to be sprayed and an internal portion located inside the hollow tube. The internal portion of the injector is contoured to form a generally oval airfoil shape within the hollow tube and a space is defined within the tube between each side of the injector and the adjacent wall of the tube. The end of the injector within the hollow tube is cut at an angle so that its face is substantially parallel to and spaced from the end of the nozzle. With this configuration, a short cylindrical mixing chamber is defined between the end of the injector and the end of the hollow tube.

In use, a source of compressed air is coupled to the compressed air nozzle and the external end of the injector is coupled through a flexible plastic tube to a source of fungicide or other liquid to be sprayed. If an automotive air conditioning system is to be treated, a small hole sized to accommodate the hollow tube of the wand can be drilled in the duct work of the system adjacent to the heat exchanger housing. Alternatively, in some vehicles, access to the heat exchanger within its housing may be gained through the internal or external vents of the vehicle so that a separate drilled hole is not necessary. In either case, the flexible hollow tube of the wand is bent and shaped so that its free end can be extended through the convolutely shaped duct work to the vicinity of the heat exchanger or surface to be treated. The tube is then inserted into the duct work and snaked about until its distal end is properly positioned for application.

With the free end of the hollow tube of the wand properly located, the compressed air valve is depressed by the user.

This causes a stream of dry compressed air to move along the hollow tube. As the stream encounters the airfoil shaped injector adjacent the end of the tube, it splits to move around the two sides of the injector and then moves beyond the angled end of the injector into the cylindrical mixing chamber. The splitting of the air stream around the airfoil shape of the injector creates a zone of relatively low pressure just beyond the angled end of the injector in the mixing chamber. This low pressure zone has two effects. First, it causes liquid to be drawn at a predetermined rate from the liquid source, through the injector, and into the mixing chamber. Second, it causes the air stream to collapse onto itself as it moves into the mixing chamber creating turbulence within the chamber. It has been found that this turbulence within the mixing chamber causes the liquid to be efficiently atomized and entrained into the air flow before it is sprayed from the wand. The result is a fine, even, and widely dispersed aerosol spray issuing from the free end of the wand.

The aerosol spray generated by this invention effectively covers and coats surfaces that are adjacent the end of the wand with a thin, evenly distributed layer of fungicide or other liquid. If it is the heat exchanger of an automotive air conditioning system that is treated, the surface of the exchanger as well as its metal fins are well coated. Likewise, if it is the interior walls of duct work that is treated, they too are covered completely. A user does not necessarily have to see the area being treated because effective coverage is assured by the effective tip mixing action of the wand. Further, the character of the spray is independent of the length of the hollow tube and independent of the shape into which the tube is bent to extend through the duct work.

Since the aerosol is ejected from the end of the wand immediately after being created in the mixing chamber, it retains its finely dispersed quality and does not tend to agglomerate into larger droplets and blobs. The ultimate result is effective and reliable treatment of inaccessible surfaces that can support unhealthy and odor causing fungi and bacteria. The wand of this invention is easily reconfigurable for use with a wide variety of air conditioning systems, is inexpensive to produce and use, and is not subject to clogging that can occur in some prior art systems.

Thus, it is seen that an improved aerosol delivery wand is now provided that effectively addresses the problems and shortcomings of the prior art. The wand provides an evenly distributed, widely dispersed aerosol spray and is easily bent and adapted to convolute shapes for snaking into inaccessible locations. These and other objects, features, and advantages of the invention will become more apparent upon review of the detailed description when taken in conjunction with the accompanying drawing figures, which are briefly described as follows.

DETAILED DESCRIPTION OF THE PREFERRED EMBODIMENT

Figure 1:
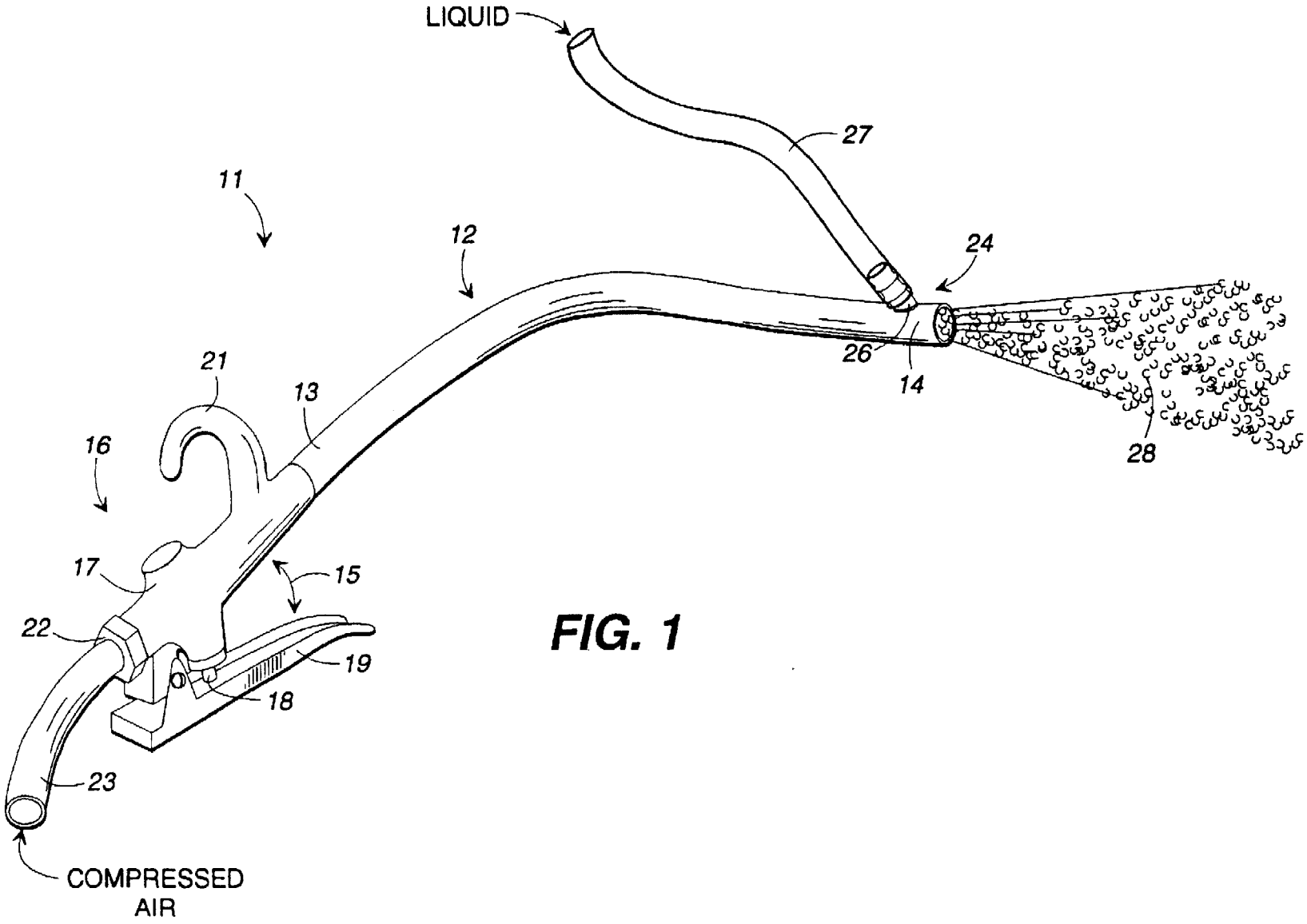
FIG. 1 is a perspective view of an aerosol delivery wand that embodies principles of the present invention in a preferred form.

Referring now in more detail to the drawings, in which like numerals refer to like parts throughout the several views, FIG. 1 illustrates an aerosol delivery wand that embodies principals of the present invention in a preferred form. The wand 11 comprises an elongated hollow tube 12 having a proximal end 13 and a distal end 14. The hollow tube 12 preferably is formed of a bendable, flexible material that will allow the tube to be bent and shaped as necessary to be snaked through convolutely shaped duct work. In the preferred embodiment, the hollow tube 12 is made of copper; however, other suitable material might also be used with comparable results.

The proximal end 13 of the tube 12 is coupled to a hand-held, manually operable compressed air valve 16. The valve 16 comprises a valve body 17 having a projecting valve stem 18. A valve trigger 19 is pivotally attached to the valve body 17 and is movable in the directions indicated by arrows 15. A finger rest 21 provides a stop against which a user's finger can rest during operation. When the valve trigger 19 is depressed against the valve stem 18, the valve 16 is opened to admit compressed air through the valve and into the hollow tube 12. A compressed air supply hose 23 is coupled via coupler 22 to the valve 16 and extends to a remote source of compressed air.

A relatively short, tubular injector 24 extends through the wall of the hollow tube 12 adjacent the distal end thereof. The injector 24 has an exterior portion 26, which forms a nipple for coupling the injector to a source of liquid to be sprayed, and an interior portion 29 (FIG. 2) that is located inside the passageway of the hollow tube 12. The external portion 26 of the injector 24 is coupled to a liquid supply hose 27 that, in turn, is coupled to a source of liquid to be sprayed. In the preferred embodiment, it is intended that a fungicide, biocide, or sporocide be sprayed on internal components of an air conditioning system. However, other liquids might also be sprayed with the present invention and the invention is not limited to a particular application. As described in more detail below, when the aerosol wand of the present invention is operated, a widely dispersed evenly distributed aerosol 28 is ejected from the end of the hollow tube 12 to provide an even coating on adjacent surfaces.

Figure 2:
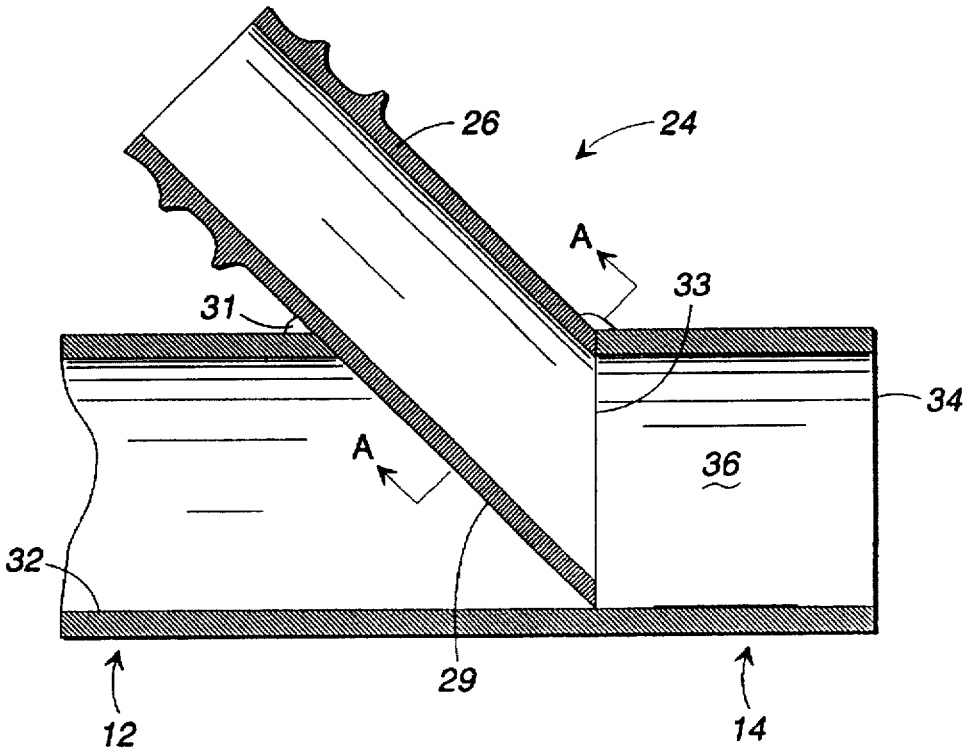
FIG. 2 is a cross-sectional view of the free end of the wand illustrating the injector and the tip mixing chamber.

FIG. 2 is a cross-sectional view of the distal end portion 14 of the hollow tube 12. The tubular injector 24 is seen in FIG. 2 to extend through the wall 32 of the hollow tube 12 and to extend completely through the internal passageway of the tube to the opposite wall thereof. The injector 24 is secured and sealed to the hollow tube 12 by means of solder 31 or other appropriate means. The injector 24 extends into the tube 12 at a predetermined angle relative to the tube. In practice, it has been found that an angle of about 45° functions well with the invention. However, other angles might well be used with comparable results.

The internal end of the tubular injector 24 is cut at an angle to form an end face 33 that is substantially parallel to and spaced from the end 34 of the hollow tube 12. With this configuration, a short cylindrical mixing chamber 36 is defined between the end face 33 of the injector 24 and the end 34 of the hollow tube 12. As detailed below, the mixing chamber 36 in conjunction with other functional elements of the invention, results in a superior, uniform, and widely dispersed aerosol.

Figure 3:
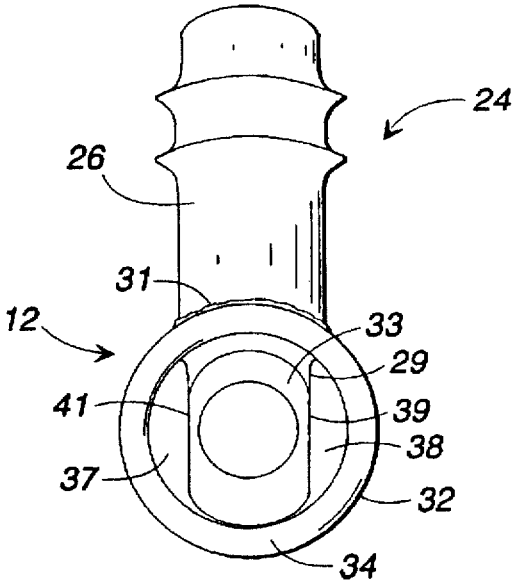
FIG. 3 is an elevational view of the free end of the wand illustrating the contoured airfoil-like shape of the interior portion of the injector.
Figure 4:
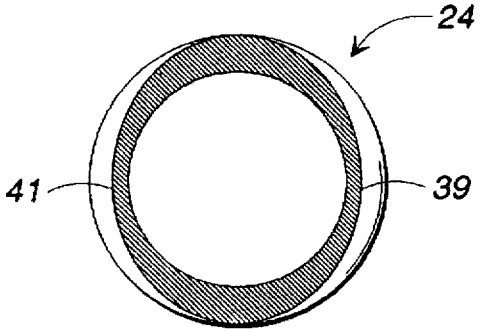
FIG. 4 is a cross-sectional view of the interior portion of the injector showing the contoured airfoil shape thereof.

FIGS. 3 and 4 illustrate the unique configuration of components in the present invention that gives rise to the superior aerosol spray. The tubular injector 24 is seen extending through the wall 32 of the hollow tube 12 and is sealed thereto by means of solder 31. The external portion 26 of the injector 24 forms a nipple for attachment to a liquid supply hose. The interior portion 29 of the injector 24 extends completely through the interior passageway of the hollow tube 12 to the opposite wall thereof. Thus, the internal portion 29 of the injector 24 spans the width of the internal passageway of the hollow tube from the top to the bottom thereof.

As best seen in FIG. 4, the sides of the internal portion 29 of the injector 24 are shaped and contoured to define a somewhat oval aerodynamic configuration. The contoured sides of the injector 24 define, with the interior walls of the hollow tube, a pair of spaced apart passageways 37 and 38 on either side of the injector 24. Further, the contour of the internal portion of the injector 24 forms a smoothly divergent airfoil shape that is presented to a stream of air moving along the hollow tube. When an airstream encounters the contoured back side of the injector 24, it is split and moves smoothly around the sides of the injector through the passages 37 and 38. Because of the airfoil shape of the injector within the tube, the splitting of the airstream occurs in a substantially laminar fashion without causing a substantial amount of turbulence at the point where the airstream engages the injector and is split thereby.

Figure 5:
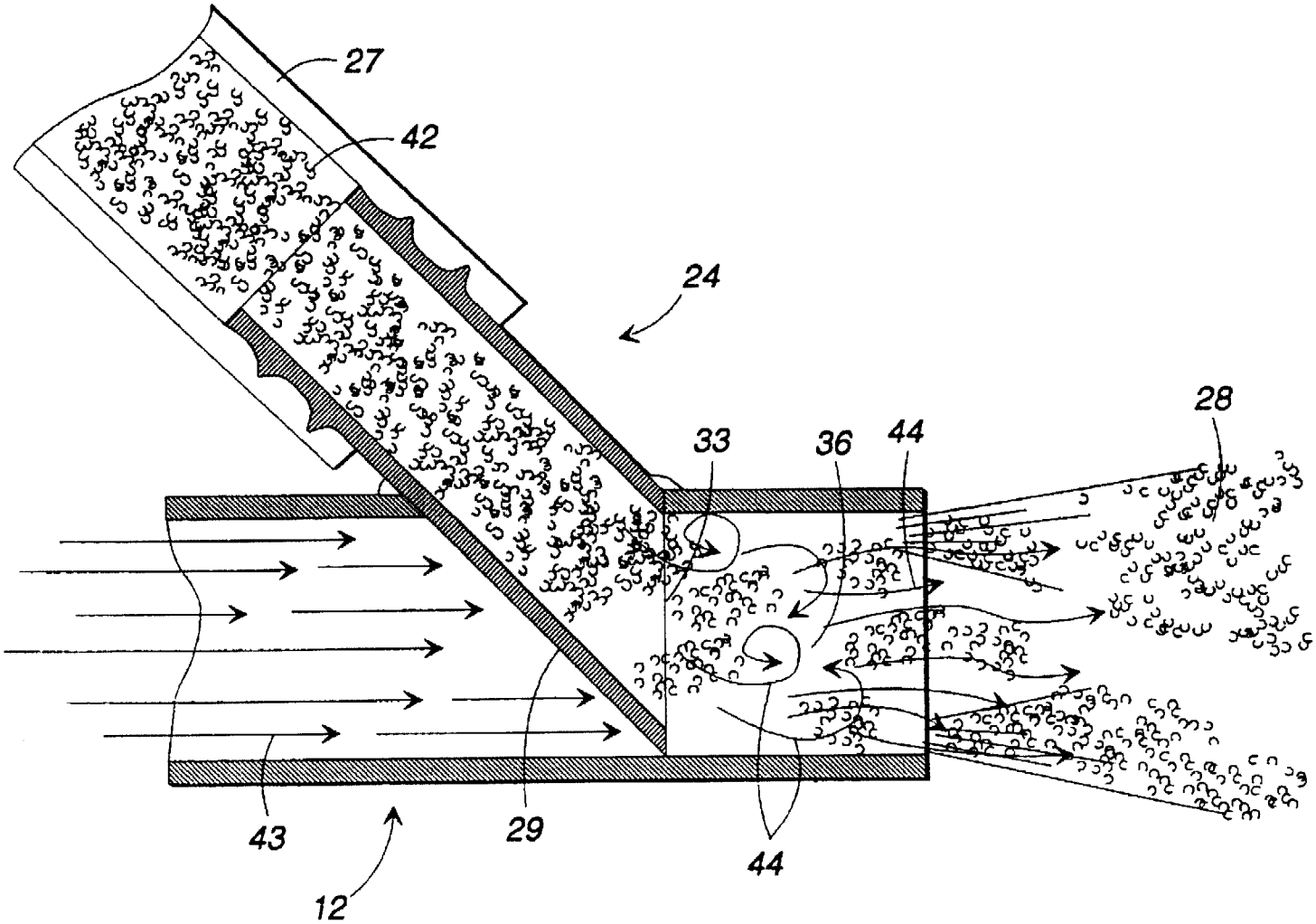
FIG. 5 is a cross-sectional view of the end of the wand illustrating the turbulent mixing action in the mixing chamber, which action creates the aerosol spray.

FIG. 5 illustrates the function of the present invention to create its superior aerosol spray 28. As an airstream 43 moves rapidly along the hollow tube 12, it engages the back side of the interior portion 29 of the injector 24. Because of the aerodynamic airfoil shape of this interior portion, the airstream is split smoothly and moves around the injector through the spaced passages 37 and 38. As this split airstream moves beyond the end 33 of the injector 24, it generates a relatively low pressure area in the region just beyond the end of the injector. This low pressure area has two beneficial effects. First, liquid 42 is drawn by the reduced pressure out of the end of the injector 24 and into the mixing chamber 36. Second, the region of reduced pressure causes the split airstreams to collapse on themselves within the mixing chamber. A relatively violent turbulent flow 44 is thus created inside the mixing chamber. This turbulent flow causes the liquid 42 to be dispersed into fine droplets that are entrained within the flow and that are ejected with the flow in the form of an aerosol 28.

It has been found that the configuration of the present invention produces an aerosol of superior quality that is widely dispersed and evenly distributed. In addition, since the mixing chamber is located at the distal tip end of the wand, the quality of the aerosol is independent of the length of the wand and also independent of its shape. Accordingly, the wand can be bent and configured to virtually any convolute shape necessary to snake the wand through the air conditioning ducts of an automobile and position the distal end thereof adjacent to surfaces to be treated. When the end of the wand is in position adjacent, for example, an air conditioning heat exchanger, the compressed air valve 17 can be actuated, which issues the aerosol 28 from the distal end of the wand. Because of the evenly distributed highly dispersed nature of the aerosol, surfaces in front of the end of the wand are coated completely and evenly with the biocide or other treatment being applied. Thus, in the case of an automobile, effective treatment is assured even if a user cannot see the area being treated. If more than one region within the air conditioning ducts is to be treated, the wand can be removed, reconfigured and snaked into that region, whereupon application is accomplished by the method described.

The invention has been described herein in terms of preferred embodiments. It will be obvious to those of skill in the art, however, that various modifications might well be made to the illustrated embodiments within the scope of the invention. For example, a particular style of compressed air valve has been illustrated in the preferred embodiment. Obviously, however, any suitable means for delivering compressed air to the hollow tube 12 is contemplated by the invention. In addition, while the hollow tube 12 is formed of copper in the preferred embodiment, any material that can be bent and shaped would be an equivalent. For example, an aluminum tube or an accordion steel tube might well be employed. Finally, while the present invention is intended for use in treating inaccessible interior portions of air conditioning systems with biocides, fungicides, and sporocides, the invention clearly has many other uses and can be used to apply liquids in the form of an aerosol in virtually any application. These and other additions, deletions, and modifications might well be made to the illustrated embodiments without departing from the spirit and scope of the invention as set forth in the claims.

I claim:

1. A method of delivering a liquid from a liquid source to inaccessible remote surfaces within an automotive air conditioning system including surfaces of a heat exchanger and interior surfaces of automotive air conditioning system duct work to treat the surfaces for bacterial and fungal growth, said method comprising the steps of:

(a) passing a flexible elongated hollow tube having a first end and a spaced second end into the automotive air conditioning system;

(b) maneuvering said flexible tube through the duct work to position the second end of said flexible tube adjacent the remote location;

(c) delivering the liquid through an injector into said flexible tube adjacent the second end thereof;

(d) selectively directing an air flow through said flexible tube and across said injector to create a region of low pressure within said flexible tube downstream of said injector wherein the liquid from said injector is drawn;

(e) atomizing the liquid drawn through said injector with turbulent air flow created between said area of low pressure and the second end of said flexible tube;

(f) entraining said atomized liquid in said turbulent air flow; and (g) dispersing said entrained liquid from the second end of said flexible tube as an aerosol spray to coat the remote surfaces adjacent the second end of said flexible tube.

2. The method as claimed in claim 1 further comprising the step of coupling a liquid supply hose to said injector, said liquid supply hose being constructed and arranged to deliver liquid from the liquid source to said injector.

3. The method as claimed in claim 1 further comprising the step of selectively actuating a compressed air valve to deliver said air flow to the first end of said flexible elongated hollow tube.

4. The method as claimed in claim 1 wherein step (a) includes the step of creating an opening in the duct work of the automotive air conditioning system adjacent the heat exchanger, said opening being sized and shaped to slidably receive said flexible elongated hollow tube.

5. The method as claimed in claim 1 wherein said flexible elongated hollow tube is formed of copper.

6. The method as claimed in claim 1 wherein said flexible elongated hollow tube is formed of aluminum.

7. The method as claimed in claim 1 wherein said flexible elongated hollow tube is formed of accordion steel.

8. An aerosol delivery wand for delivering a liquid in the form of an aerosol spray to an inaccessible remote location, said aerosol delivery wand comprising an elongated hollow tube formed of a bendable reconfigurable material and having a proximal end, a distal end, and an internal wall, means on said proximal end of said hollow tube for delivering a stream of compressed air to said hollow tube, a tubular injector extending into said hollow tube adjacent said distal end thereof, said injector having an external portion projecting out of said hollow tube and an interior portion positioned within said hollow tube, said interior portion of said injector having contoured sides that define air passages with the interior wall of said hollow tube, said injector having an end spaced from said distal end of said hollow tube and defining a mixing chamber between said end of said injector and said distal end of said hollow tube, and means for delivering liquid to said external end of said tubular injector, the liquid being drawn through said tubular injector into said mixing chamber by movement of compressed air past the internal portion of the injector and being entrained in the air flow within the mixing chamber and expelled from the distal end of the hollow tube as an aerosol.

9. An aerosol delivery wand as claimed in claim 8 and wherein said means for delivering a stream of compressed air comprises a manually actuatable hand held compressed air valve coupled to said hollow tube.

10. An aerosol delivery wand as claimed in claim 8 and wherein said injector extends into said hollow tube at a predetermined angle relative to said hollow tube.

11. An aerosol delivery wand as claimed in claim 10 and wherein said predetermined angle is about 45 degrees.

12. An aerosol delivery wand as claimed in claim 10 and wherein said end of said injector within said hollow tube is cut to define an end face that is substantially parallel to and spaced from said distal end of said hollow tube.

13. An aerosol delivery wand as claimed in claim 12 and wherein said contoured sides of said interior portion of said tubular injector define an airfoil shape for splitting a compressed air stream into two components that move through said passageways and then into said mixing chamber.

14. An aerosol delivery wand as claimed in claim 8 and wherein said material is copper.

15. An aerosol delivery wand as claimed in claim 8 and wherein said material is aluminum.

16. An aerosol delivery wand as claimed in claim 8 and wherein said material is accordion steel.

17. An aerosol delivery wand comprising a bendable reconfigurable elongated hollow tube having a proximal end, a distal end, and an interior wall, means at said proximal end for selectively delivering a stream of compressed air to said tube, a mixing chamber defined in said hollow tube adjacent the distal end thereof, and injector means extending into said hollow tube for supplying liquid to said mixing chamber, said injector means having an interior portion located inside said hollow tube with said interior portion having contoured sides that define a pair of spaced apart air passageways with said interior wall of said hollow tube.

18. An aerosol delivery wand as claimed in claim 17 and wherein said injector means comprises a tubular injector extending through the wall of said hollow tube to said interior portion of said injector, and means for coupling said injector to a source of liquid to be delivered through said injector.

19. An aerosol delivery wand as claimed in claim 18 and wherein said tubular injector extends through the wall of said hollow tube at a predetermined angle relative thereto.

20. An aerosol delivery wand as claimed in claim 19 and wherein said interior portion of said injector has an end and wherein said end is cut to define and end face that is oriented substantially parallel to and spaced from said distal end of said hollow tube, said mixing chamber being defined between said end of said injector and the distal end of said hollow tube.

21. An aerosol delivery wand as claimed in claim 20 and wherein said contoured sides of said interior portion of said injector are configured to define an airfoil shape.

22. An aerosol delivery wand as claimed in claim 17 and wherein said bendable reconfigurable elongated hollow tube is formed of copper.

23. An aerosol delivery wand as claimed in claim 17 and wherein said flexible elongated hollow tube is formed of aluminum.

24. An aerosol delivery wand as claimed in claim 17 and wherein said flexible elongated hollow tube is formed of accordion steel.

* * * * *